US005308710A

United States Patent [19]

Takeda et al.

[11] Patent Number: 5,308,710

[45] Date of Patent: May 3, 1994

[54] AL-ZN-SI BASE ALLOY COATED PRODUCT

[75] Inventors: Masanori Takeda, Amagasaki; Youichiro Suzuki, Mizunami; Kunio Hayakawa, Aichi, all of Japan

[73] Assignees: Daido Steel Sheet Corp., Hyogo; S-Tem Ltd., Nagoya, both of Japan

[21] Appl. No.: 957,868

[22] Filed: Oct. 8, 1992

[30] Foreign Application Priority Data

Nov. 29, 1991 [JP] Japan ..... 3-316918

[51] Int. Cl.[5] ..... B32B 15/18; C23C 2/06; C23C 2/12

[52] U.S. Cl. ..... 428/653; 428/659; 428/939

[58] Field of Search ..... 428/659, 653, 654, 939

[56] References Cited

U.S. PATENT DOCUMENTS

| | | | |
|---|---|---|---|
| 3,343,930 | 9/1967 | Borzillo et al. | 428/653 |
| 3,782,909 | 1/1974 | Cleary et al. | 428/653 |
| 3,952,120 | 4/1976 | Horton et al. | 428/653 |
| 4,264,684 | 4/1981 | Allegra et al. | 428/653 |
| 4,287,008 | 9/1981 | Torok et al. | 428/653 |
| 4,330,598 | 5/1982 | Lee et al. | 428/659 |
| 4,350,540 | 9/1982 | Allegra et al. | 428/653 |
| 4,401,727 | 8/1983 | Berke et al. | 428/659 |
| 4,456,663 | 6/1984 | Leonard | 428/653 |
| 4,722,871 | 2/1988 | Radke et al. | 428/659 |

FOREIGN PATENT DOCUMENTS

| | | | |
|---|---|---|---|
| 64176/80 | 5/1981 | Australia . | |
| 83288 | 3/1983 | Australia . | |
| 91047/82 | 6/1983 | Australia . | |
| 2553051 | 8/1976 | Fed. Rep. of Germany . | |
| 53-81434 | 7/1978 | Japan | 428/659 |
| 63-63626 | 12/1988 | Japan . | |
| 1-263255 | 10/1989 | Japan . | |
| 2-109846 | 4/1990 | Japan | 428/653 |
| 2-267282 | 11/1990 | Japan | 428/659 |
| 2243843 | 11/1991 | United Kingdom . | |

*Primary Examiner*—John Zimmerman
*Attorney, Agent, or Firm*—Armstrong, Westerman, Hattori, McLeland & Naughton

[57] ABSTRACT

An Al-Zn-Si base alloy coat including an Al-Zn-Si-Fe alloy layer which has remarkable high corrosion resistance is formed on an article. A ferrous base material is used as the article to provide Fe to the alloy layer. The alloy layer of the present invention consists of 55 to 65 wt % of Al, 25 to 35 wt % of Zn, 5 to 10 wt % of Fe, and 2 to 4 wt % of Si, and also has a cross sectional area of 15 to 90% of the entire cross sectional area of the alloy coat. A process for forming the alloy coat of the present invention comprises the step of dipping the article into a molten bath of Zn to form, on the article, an undercoat which results from a reaction between Fe of the article and Zn in the molten bath, and then dipping the undercoat into an alloy molten bath of Al, Zn and Si to form the alloy coat of the present invention on the undercoat.

10 Claims, 9 Drawing Sheets

AL-ZN-SI BASE ALLOY COATED PRODUCT

BACKGROUND OF THE INVENTION

1. Field of the Invention

The present invention is directed to an alloy coated product with an Al-Zn-Si base alloy coat including an Al-Zn-Fe-Si alloy layer and a method for making the same.

2. Description of the Prior Art

A zinc coating is generally used to provide corrosion resistance to a ferrous-base material. However, higher corrosion resistance is required to use the ferrous material in severe corrosive environments, e.g., a salt spray area such as a seaside, an area having acid rain. From this point of view, many kinds of Al-Zn alloy coats were developed. The demands of the Al-Zn alloy coats are increasing because the Al-Zn alloy coats has superior corrosion resistance than the Zn coat. Japanese Patent Publication [KOKOKU]No. 63-63626 describes a steel wire coated with an Al-Zn alloy containing 3 to 10 wt % of Al. Suzuki et al. Japanese patent early publication [KOKAI]No. 1-263255 also describes a method of Al-Zn alloy coating, which includes the steps of dipping an article into a molten bath of Zn at a bath temperature in a range of 480° to 560° C. to form an undercoat on the article, and subsequently dipping the undercoat into an alloy molten bath containing at least 1 wt % of Al at a bath temperature in a range of 390° to 460° C. to form an Zn-Al alloy coat on the undercoat. The alloy molten bath preferably includes 0.1 to 10 wt % of Al. In case of an Al content less than 0.1%, the desired effect of Al, which is to greatly enhance corrosion resistance of the alloy coat, is not obtained. On the other hand, when the alloy molten bath includes more than 10 wt % of Al, a typical ferrous metal bath container and the article are harmfully attached by the molten metals of the alloy molten bath. However, when we think about a corrosion protective coat used under more severe corrosive conditions in the future, an alloy coat having superior corrosion resistance as compared with the Zn-Al alloy coat will be requested.

SUMMARY OF THE INVENTION

The present invention provides, on an article, an Al-Zn-Si base alloy coat comprising an Al-Zn-Si-Fe alloy layer which has remarkable high corrosion resistance and to a process for forming the alloy coat. The article is made from ferrous base material to provide Fe to the alloy coat. The alloy coat consists essentially of three layers, that is, an interface layer, an intermediate layer and an outer layer. The Al-Zn-Si-Fe alloy layer of the present invention, which is the intermediate layer, includes about 55 to 65 wt % of Al, about 5 to 10 wt % of Fe, about 2 to 4 wt % of Si and about 25 to 35 wt % of Zn, and is also formed into a granular structure or a fine and zonal structure. The intermediate layer has a cross sectional area of 15 to 90 % of the entire cross sectional area of the alloy coat of the present invention.

It is, therefore, an object of the present invention to provide an Al-Zn-Si base alloy coat including an Al-Zn-Si-Fe alloy layer which has excellent corrosion resistance.

The process for forming the alloy coat of the present invention comprises dipping the article into a molten bath of Zn to form, on the article, an undercoat as a reaction layer between Fe of the article and Zn in the molten bath, and then dipping the undercoat into an alloy molten bath of Al, Zn and Si to form the alloy coat on the undercoat.

It is a further object of the present invention to Zn-Si base alloy coat including an Al-Zn-Si-Fe alloy layer having excellent corrosion resistance.

It is also preferred that the alloy coat is cooled at an optimum cooling rate in order to obtain a smooth surface and uniformity of the alloy coat after being withdrawn from the alloy molten bath.

The alloy coat and the process for forming the alloy coat of the present invention will be detailed hereinafter.

DETAILED DESCRIPTION OF THE INVENTION

An Al-Zn-Si base alloy coat including an Al-Zn-Si-Fe alloy layer which has excellent corrosion resistance is made according to a process of the present invention.

A steel or a cast iron is used as an article. Before the article is dipped into a Zn molten bath, pre-treatments are performed on a surface of the article in accordance with the following order: alkali cleaning, water cleaning, acid cleaning, water cleaning, and a flux treatment. Each of the pre-treatments is the same way as a general hot-dip Zn coating. For example, the article is cleaned in an alkali solution bath comprising NaOH or NaOH+NazO 2SiOz nHzO at a temperature of 70° to 80° C. The water cleaning is done at ambient temperature, and then the article is cleaned in aqueous solution containing hydrochloric acid at ambient temperature. Subsequently, the flux treatment is done in aqueous solution containing zinc chloride and ammonium chloride at a temperature of 80° to 90° C.

A hot-dip coating of the present invention essentially consists of first and second hot dipping steps. The most important reason for adopting the two steps of the hot-dip coating is to prevent a poor quality alloy coat of poor and also to stably obtain a smooth surface and uniformity of the alloy coat. The first hot dipping step is performed under the conditions described below. After the above pre-treatments have been completed, the article is dipped into the Zn molten bath to form an undercoat on the article. The formation of the undercoat is very important to obtain the smooth surface and the uniformity of the alloy coat. The alloy coat is basically formed through a substitutional reaction between the undercoat and molten metals in an alloy molten bath.

The Zn molten bath includes at least one metal selected from a group consisting of Al, Si, Mg, Ti, In, Tl, Sb, Nb, Co, Bi, Mn, Na, Ca, Ba, Ni, and Cr. When the Zn molten bath includes 0.1 to 5.0 wt % of Al, an uniform undercoat is formed on the article because the reaction between Fe of the article and Zn of the Zn molten bath is suitably controlled by Al in the Zn molten bath. The Zn molten bath also includes desirably 0.03 to 2.0 wt % of Ni to obtain a uniform undercoat. An addition of 0.01 to 0.5 wt % of Mg into the Zn molten bath is more effective to obtain the uniform undercoat. Further, a small amount of addition of Ti, Ni, Al and Si, for example, 0.1 to 2.0 wt % of Ti, 0.1 to 1.6 wt % of Ni, 0.1 to 1.6 wt % of Al and 0.01 to 0.03 wt % of Si, is preferable to obtain the uniform undercoat.

The Zn molten bath is used at a temperature of 430° to 560° C., and preferably 440° to 460° C. In case of the bath temperature higher than 560° C., it is difficult to obtain the uniform undercoat. The article is dipped into the Zn molten bath for 10 to 600 seconds and preferably 15 to 60 seconds. When the undercoat is formed by dipping the article into the Zn molten bath for more than 600 seconds, the smooth surface of the alloy coat is not obtained on the undercoat in the second hot dipping step. The article with the undercoat is withdrawn from the Zn molten bath at a withdrawal rate of 1.0 to 10 m/min and preferably 2 to 4 m/min. In case of the withdrawal rate slower than 1.0 m/min, the smooth surface of the alloy coat is not formed on the undercoat in the second hot dipping step. The article with the undercoat is also transported from the Zn molten bath to the alloy molten bath within 90 seconds or less and preferably in a range of 10 to 30 seconds. When the article is transported from the Zn molten bath to the alloy molten bath within more than 90 seconds, the smooth surface and the uniformity of the alloy coat is not obtained in the second hot dipping step.

The second hot dipping step of the present invention is performed under the conditions described below. The article with..the..undercoat is dipped into the alloy molten bath consisting essentially of 20 to 70 wt % of Al and preferably 30 to 60 wt % of Al, 0.5 to 4.0 wt % of Si and preferably 2.0 to 3.5 wt % of Si, and the balance of Zn, so that the alloy coat is formed on the undercoat. When the Si content in the alloy molten bath is less than 0.5 wt %, or more than 4 wt %, it is difficult to form, on the undercoat, the alloy coat having remarkable high corrosion resistance. The alloy molten bath is used at a temperature of 570° to 670° C. and preferably 580° to 610° C. In case of the bath temperature lower than 570° C., a large amount of dross is generated in the alloy molten bath. When the bath temperature higher than 670° C. is adopted in the second hot dipping step, the alloy coat having a rough surface is formed on the undercoat. The article with the undercoat is dipped into the alloy molten bath for 5 to 600 seconds and preferably 15 to 45 seconds. When the article with the undercoat is dipped into the alloy molten bath for more than 600 seconds, the alloy coat having the rough surface is formed on the undercoat. It is further preferred that the alloy molten bath is continuously vibrated to prevent adherence of a floating dross to the alloy coat during the second hot dipping step. When the article with the alloy coat is withdrawn from the alloy molten bath at a withdrawal rate of 1.0 to 10 m/min and preferably 6 to 9 m/min, no adherence of the floating dross to the alloy coat is observed. The alloy coat is cooled at a particular cooling rate between 670° C. and 370° C., and preferably between 610° C. and 370° C. The particular cooling rate is −15° C//sec or less and preferably in a range of −3° to −7° C./sec in order to obtain the smooth surface and the coat is cooled at a rapid cooling rate, for example, more than −30° C./sec, the article is depreciated by discoloration of the alloy coat.

Thus obtained alloy coat of the present invention substantially consists of an interface layer 4, an intermediate layer 2 and an outer layer 5 as shown in FIGS. 1 and 2. As the alloy coat 3 is basically formed through the substitutional reaction between the undercoat and molten metals in the alloy molten bath, the undercoat is not observed on the article after the second hot dipping step has been completed. The intermediate layer 2 is the Al-Zn-Si-Fe alloy layer having remarkable high corrosion resistance. That is to say, the intermediate layer essentially consists of 25 to 35 wt % of Zn, 55 to 65 wt % of Al, 5 to 10 wt % of Fe and 2 to 4 wt % of Si, and has a cross sectional area of 15 to 90 % of the entire cross sectional area of the alloy coat. The intermediate layer 2 also has a granular structure as shown in FIG. 1, or a fine and zonal, i.e., densely distributed structure as shown in FIG. 2. For example, when the Si content in the alloy molten bath is in a range of 1.8 to 2.1 wt %, the intermediate layer is formed into the granular structure. On the other hand, when the Si content in the alloy molten bath is in a range of 2.1 to 2.8 wt %, the intermediate layer is formed into the fine and zonal structure. The fine and zonal structure of the intermediate layer can be also formed by cooling the alloy coat at an optimum cooling rate after the alloy coat has been withdrawn from the alloy molten bath. A hardness of the intermediate layer measured by micro Vickers hardness test is about 150 to 200 Hv. On the other hand, the interface layer is the Al-Zn- Fe-Si alloy layer having different composition from the intermediate layer, that is, the interface layer includes a large amount of Fe and Si and a small amount of Zn compared with the intermediate layer. The interface layer which has a hardness of about 450 to 500 Hv is much harder than the intermediate layer. The outer alloy layer is a solidification layer essentially consisting of Al, Zn, and Si. However, the outer layer does not always need to obtain excellent corrosion resistance of the present invention. For example, in case of making a bolt coated with the alloy of the present invention, the outer layer of the alloy coat is peeled off to maintain the tolerance of the bolt by a centrifugation method. By this treatment, the alloy coat essentially consists of the interface layer and the intermediate layer.

Further details of the present invention are described in the following examples 1 to 24. However, the examples are illustrative of the invention, but are not to be construed as to limiting the scope thereof in any manner.

EXAMPLES 1 TO 6

Figure 1:
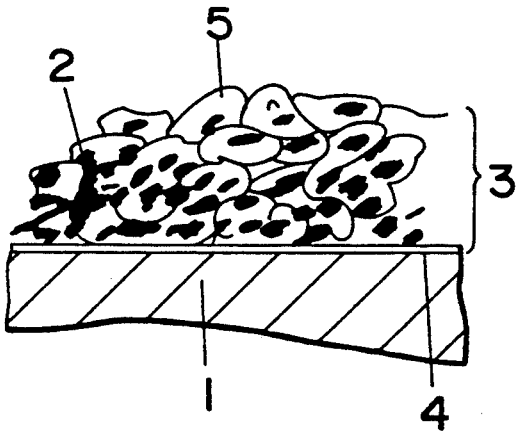
FIG. 1 illustrates a schematic cross section of an alloy coat having an intermediate layer of a granular structure of the present invention.
Figure 2:
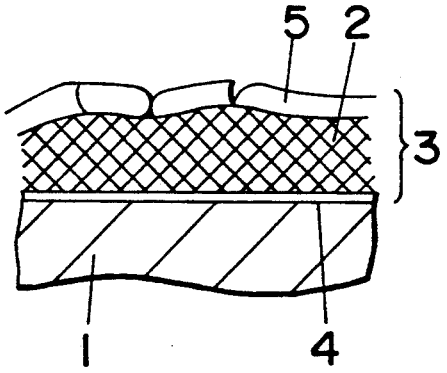
FIG. 2 illustrates a schematic cross section of an alloy coat having an intermediate layer of a fine and zonal structure of the present invention.
Figure 3:
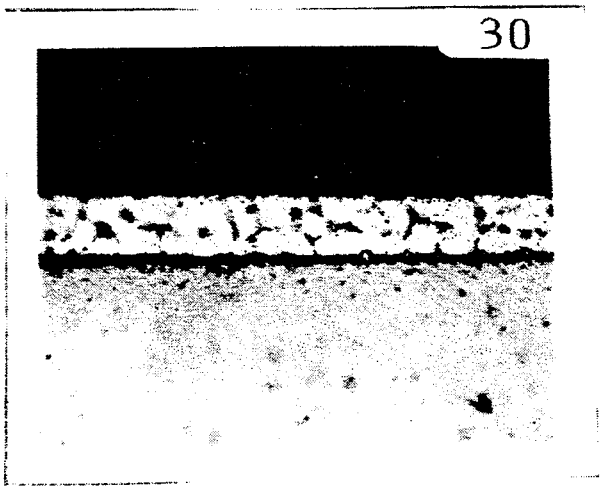
FIG. 3 is a cross section of an alloy coat of example 1 of the present invention observed by an electron microscope.
Figure 4:
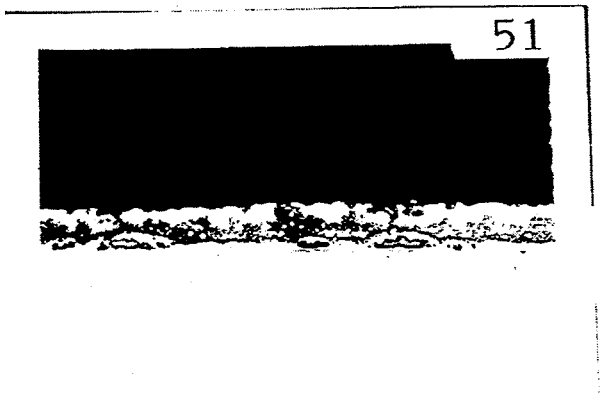
FIG. 4 is a cross section of an alloy coat of example 2 observed by the electron microscope.
Figure 5:
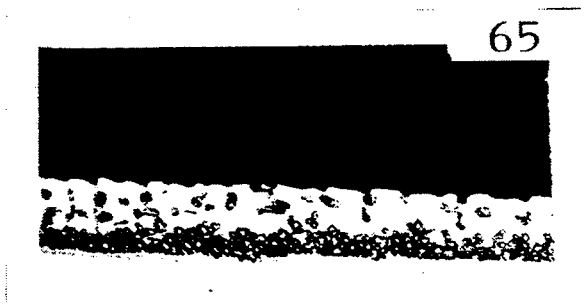
FIG. 5 is a cross section of an alloy coat of example 3 observed by the electron microscope.
Figure 6:
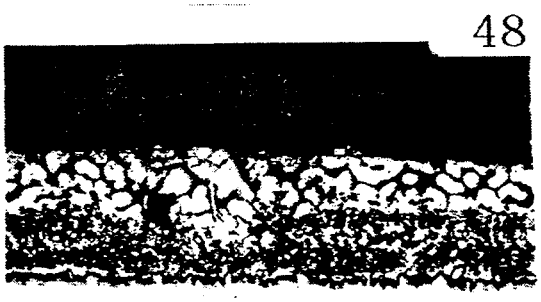
FIG. 6 is a cross section of an alloy coat of example 4 observed by the electron microscope.
Figure 7:
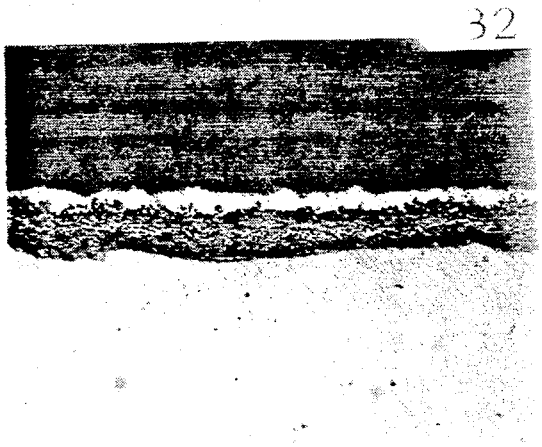
FIG. 7 is a cross section of an alloy coat of example 5 observed by the electron microscope.
Figure 8:
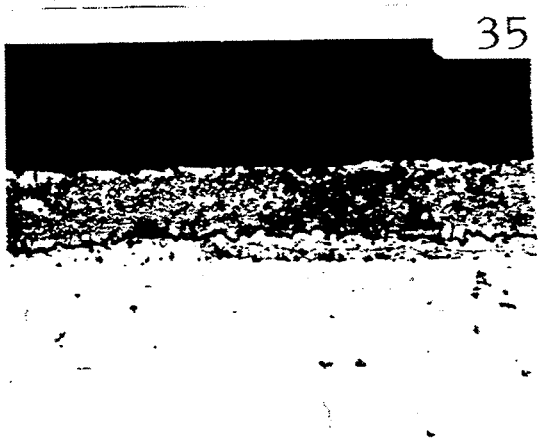
FIG. 8 is a cross section of an alloy coat of example 6 observed by the electron microscope.
Figure 9:
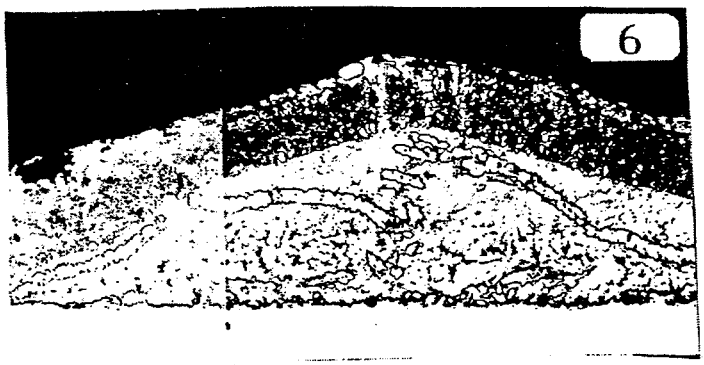
FIG. 9 is a cross section of an alloy coat of example 7 observed by the electron microscope.
Figure 10:
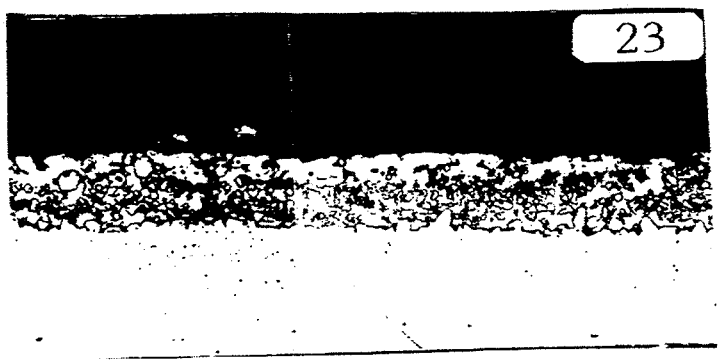
FIG. 10 is a cross section of an alloy coat of example 8 observed by the electron microscope.
Figure 11:
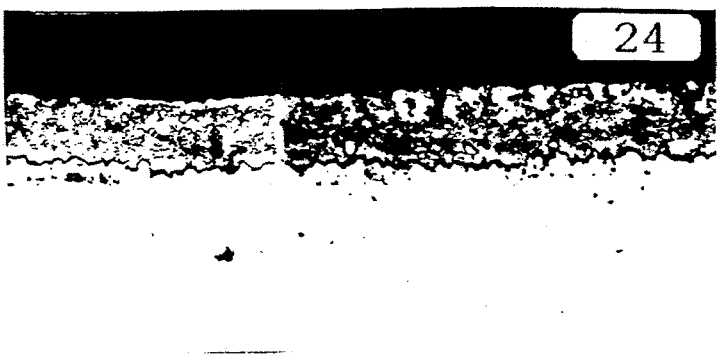
FIG. 11 is a cross section of an alloy coat of example 9 observed by the electron microscope.
Figure 12:
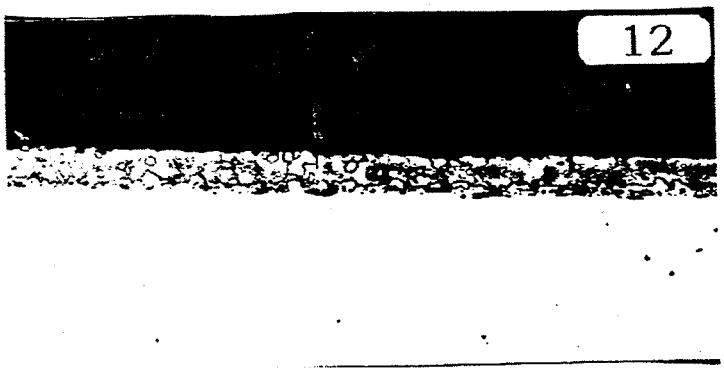
FIG. 12 is a cross section of an alloy coat of example 10 observed by the electron microscope.
Figure 13:
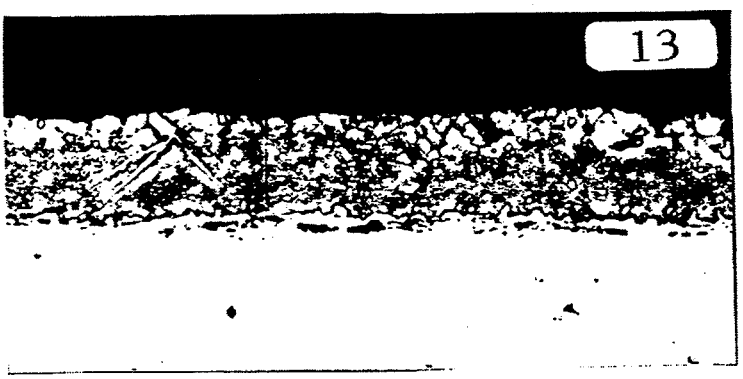
FIG. 13 is a cross section of an alloy coat of example 11 observed by the electron microscope.
Figure 14:
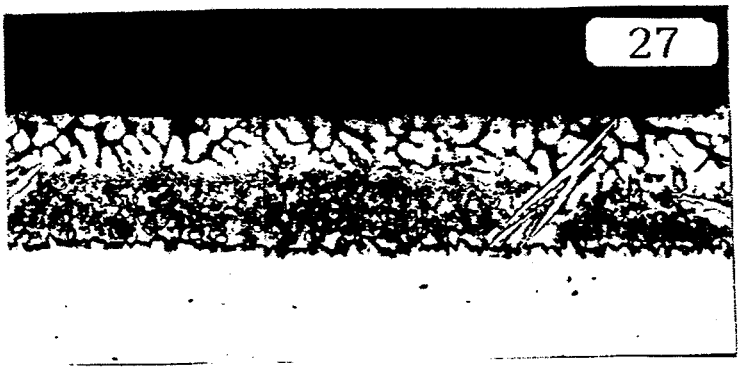
FIG. 14 is a cross section of an alloy coat of example 12 observed by the electron microscope.
Figure 15:
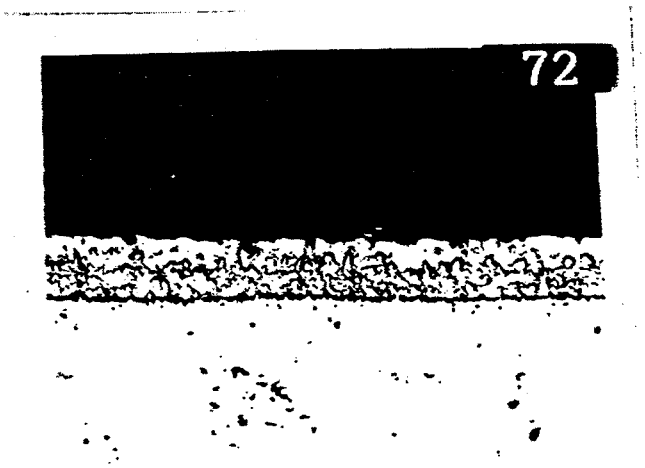
FIG. 15 is a cross section of an alloy coat of example 13 observed by the electron microscope.
Figure 16:
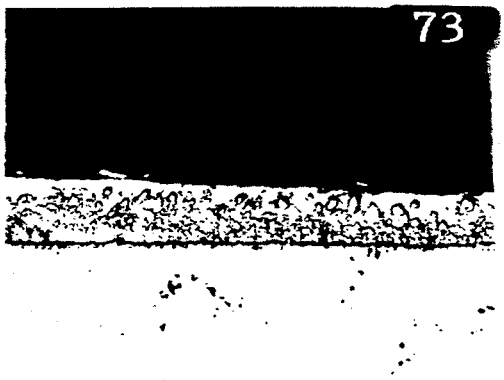
FIG. 16 is a cross section of an alloy coat of example 14 observed by the electron microscope.

Each of alloy coats of examples 1 to 6 of the present invention, which is Al-Zn-Si base alloy coat including an Al- Zn-Si-Fe alloy layer, was formed on a ferrous base article. The Al-Zn-Si base alloy coat consists essentially of an interface layer, an intermediate layer having excellent corrosion resistance and an outer layer. Therefore, the corrosion resistance of the alloy coat, which varies relative to a ratio of a cross sectional area of the intermediate layer against the entire cross sectional area of the alloy coat, was examined in examples 1-6. The ratio of the cross sectional area of the intermediate layer were determined by observing a cross section of the alloy coat. For example, an alloy coat of example 1 having the ratio of the cross sectional area of the intermediate layer of about 5 % was produced through the following process. A steel sheet, which is 100 mm wide, 450 mm long, 3.2 mm high, was used as the ferrous base article. Before the article is dipped into a Zn molten bath, pretreatments such as alkali cleaning, water cleaning, acid cleaning, and flux treatment were performed on a surface of the article. The treatments were based on the same process as a general hot-dip Zn coating. Subsequently, the article was dipped into the Zn molten bath including 0.005 wt % of Al at a bath temperature of 460° C. for 60 seconds to form, on the article, an undercoat which results from a reaction between Fe of the article and Zn in the molten bath. The article with the undercoat was transported from the Zn molten bath to an alloy molten bath within 30 seconds. The article with the undercoat was then dipped into the alloy molten bath consisting of 55 wt % of Al, 1.5 wt % of Si, and the balance of Zn at a bath temperature of 590° C. for 40 seconds to form, on the undercoat, the alloy coat including the Al-Zn-Fe-Si alloy layer. The article with the alloy coat was cooled from 590° C. to 370° C. at a cooling rate of −10° C./sec by air after being withdrawn from the alloy molten bath. Similarity, alloy coats of examples 2-6 were respectively produced by controlling hot-dip coating conditions such as chemical compositions of the Zn molten bath and/or the alloy molten bath, the dipping time or the cooling rate, etc. The ratio of the cross sectional area of the intermediate layer can be increased by cooling the alloy coat at a slower cooling rate after the article with the alloy coat has been withdrawn from the alloy molten bath. On the other hand, comparative example was formed by the following process. The pre-treatments were performed on the article, and then the article was dipped into the Zn molten bath including 0.005 wt % of Al at the bath temperature of 480° C. for 90 seconds. Therefore, the article of comparative example were coated only with the undercoat essentially consisting of Zn and Fe. The undercoat ordinary has a plurality of crystal phases, e.g., $\eta$ phase consisting of a pure Zn and $\delta$ phase consisting of a Zn-Fe alloy, etc. More details about the hot-dip coating conditions for producing examples 1-6 and comparative example are shown on TABLE 1. TABLE 2 shows chemical composition of each layer of examples 1-6 analyzed by electron probe micro analysis (EPMA). Results of the EPMA indicate that the chemical composition of the intermediate layer essentially consists of about 55 to 65 wt % of Al, 25 to 35 wt % of Zn, 5 to 10 wt % of Fe, and 2 to 4 wt % of Si. The results also indicate that the interface layer is the Al-Zn-Fe-Si layer having different composition from the intermediate layer, that is, the interface layer includes a large amount of Fe and Si and a small amount of Zn compared with the intermediate layer. Therefore, it suggests that the interface layer results from a preferential alloy reaction between Fe, which is included in the article and the undercoat, and Al and Si which are included in the molten metals of the alloy molten bath. On the other hand, the outer layer includes a small amount of Fe and Si compared with the intermediate layer. It suggests that the outer layer is formed by a solidification of molten metals of the alloy molten bath without the preferential alloy reaction. The cross sections of the alloy coats of examples 1-6 observed by electron microscope are also shown in FIGS. 3-8, respectively. The observations show that each of the alloy coats has a smooth surface. Three corrosion tests based on Japanese Industrial Standard (JIS) were done in examples 1-6. One of the corrosion tests was performed in environment of a sulfurous acid gas in accordance with JIS H8502 test. The sulfurous acid gas concentration was 100 ppm. The environment was also held at a temperature of 40° C. and at a relative humidity of more than 90 %. Another test was a salt spray test based on JIS Z2371. The salt spray was 5 percent salt water. The last test was the same salt spray test except that acetic acid was added in the salt spray such that the salt spray has an acidity in a range of pH 3.0 to pH 3.3. Results of the corrosion tests of JIS H8502 and the salt spray test with the acetic acid are shown on TABLES 3 and 4, respectively. The results indicate that the corrosion resistance of the alloy coat of the present invention depends on the ratio of the cross sectional area of the intermediate layer against the entire cross sectional area of the alloy coat, that is, as the ratio of the cross sectional area of the intermediate layer increases, the alloy coat shows better corrosion resistance. The results also indicate that no red rust is generated on the alloy coat having the ratio of the cross sectional area of the intermediate layer of more than 40%, even after the alloy coat is exposed in the sulfurous acid gas for 1200 hours, or in the salt spray with the acetic acid for 3000 hours. On the other hand, the salt spray test of JIS Z2371 is in progress. However, no red rust is observed on all examples 1–6, even after the alloy coat was exposed in the salt spray for 5000 hours.

TABLE 1

Hot-dip coating conditions for producing examples 1 to 6 and comparative example.

| | FIRST HOT DIPPING STEP | | | | SECOND HOT DIPPING STEP | | | |
|---|---|---|---|---|---|---|---|---|
| | Bath composition (wt %) | Bath temperature (°C.) | Dipping time (sec) | Transport time*1 (sec) | Bath composition (wt %) | Bath temperature (°C.) | Dipping time (sec) | Cooling rate*2 (°C./sec) |
| Example 1 | Zn-0.005Al | 460 | 60 | 30 | Zn-55Al-1.5Si | 590 | 40 | −10 |
| Example 2 | Zn-0.005Al | 460 | 60 | 35 | Zn-55Al-1.8Si | 590 | 40 | −7 |
| Example 3 | Zn-0.005Al | 460 | 60 | 40 | Zn-55Al-2.1Si | 590 | 40 | −10 |
| Example 4 | Zn-0.5Ni | 460 | 90 | 45 | Zn-55Al-2.3Si | 590 | 90 | −7 |
| Example 5 | Zn-0.5Mg | 460 | 90 | 55 | Zn-55Al-2.5Si | 590 | 90 | −4 |
| Example 6 | Zn-0.5Al-0.5Ni | 460 | 90 | 60 | Zn-55Al-2.8Si | 590 | 90 | −2 |
| Comparative example | Zn-0.005Al | 480 | 90 | — | — | — | — | — |

*1An article with an undercoat is transported from a first molten bath to a second molten bath within a transport time.
*2An alloy coat is cooled at a cooling rate from a bath temperature of the second molten bath to 370° C. after being withdrawn from the second molten bath.

TABLE 2

Contents of Al, Zn, Fe, and Si, of alloy coats of example 1 to 6 analyzed by electron probe micro analysis (EPMA).

| | Division of alloy coat | Al (wt %) | Zn (wt %) | Fe (wt %) | Si (wt %) |
|---|---|---|---|---|---|
| Example 1 | Outer layer | 73.7 | 24.5 | 0.20 | 0.85 |
| | Intermediate layer | 63.3 | 32.0 | 8.28 | 3.16 |
| | Interface layer | 52.1 | 12.0 | 25.9 | 9.37 |
| Example 2 | Outer layer | 72.4 | 26.1 | 0.25 | 0.77 |
| | Intermediate layer | 63.7 | 27.5 | 9.40 | 3.60 |
| | Interface layer | 51.9 | 11.8 | 26.1 | 9.31 |
| Example 3 | Outer layer | 73.4 | 26.1 | 0.26 | 0.68 |
| | Intermediate layer | 62.4 | 29.9 | 8.41 | 2.95 |
| | Interface layer | 53.6 | 12.2 | 25.3 | 9.01 |
| Example 4 | Outer layer | 76.5 | 26.2 | 0.32 | 0.32 |
| | Intermediate layer | 58.9 | 33.2 | 5.18 | 2.15 |
| | Interface layer | 51.9 | 10.7 | 28.2 | 9.26 |
| Example 5 | Outer layer | 75.5 | 29.0 | 0.30 | 0.68 |
| | Intermediate layer | 61.3 | 31.8 | 4.77 | 1.95 |
| | Interface layer | 53.0 | 10.5 | 27.9 | 9.16 |
| Example 6 | Outer layer | 73.5 | 25.7 | 0.23 | 0.82 |
| | Intermediate layer | 60.2 | 32.4 | 5.84 | 2.42 |
| | Interface layer | 53.5 | 10.4 | 29.3 | 8.46 |

TABLE 3

Results of a corrosion test performed in a sulfurous acid gas environment in accordance with JIS H8502 test.

| | $C_B/C_A$ (%)*1 | Test time (hrs) 120 | 240 | 480 | 720 | 960 | 1200 |
|---|---|---|---|---|---|---|---|
| Example 1 | 1 to 5 | ○ | ○ | ○ | Δ | XX | XX |
| Example 2 | 5 to 10 | ○ | ○ | ○ | Δ | X | XX |
| Example 3 | 10 to 15 | ○ | ○ | ○ | ○ | Δ | Δ |
| Example 4 | 40 to 50 | ○ | ○ | ○ | ○ | ○ | ○ |
| Example 5 | 60 to 75 | ○ | ○ | ○ | ○ | ○ | ○ |
| Example 6 | 80 to 90 | ○ | ○ | ○ | ○ | ○ | ○ |
| Comparative example | — | ○ | X | XX | XX | XX | XX |

*1$C_B/C_A$: ratio (%) of cross sectional area ($C_B$) of the intermediate layer against the entire cross sectional area ($C_A$) of the alloy coat.
○: No red rust is generated on the alloy coat.
Δ: A small amount of spot-like rust is generated on the alloy coat.
X: Surface area of red rust generated on the alloy coat is 5% or less of the entire surface area of the alloy coat.
XX: Surface area of red rust generated on the alloy coat is more than 5% of the entire surface area of the alloy coat.

TABLE 4

Results a corrosion test performed in a salt spray with acetic acid in accordance with JIS Z2371 test.

| | $C_B/C_A$ (%)*1 | Test time (hrs) 500 | 1000 | 1500 | 2000 | 2500 | 3000 |
|---|---|---|---|---|---|---|---|
| Example 1 | 1 to 5 | ○ | ○ | Δ | X | XX | XX |
| Example 2 | 5 to 10 | ○ | ○ | ○ | Δ | X | XX |

TABLE 4-continued

Results a corrosion test performed in a salt spray with acetic acid in accordance with JIS Z2371 test.

| | $C_B/C_A$ (%)*1 | Test time (hrs) 500 | 1000 | 1500 | 2000 | 2500 | 3000 |
|---|---|---|---|---|---|---|---|
| Example 3 | 10 to 15 | ○ | ○ | ○ | ○ | Δ | Δ |
| Example 4 | 40 to 50 | ○ | ○ | ○ | ○ | ○ | ○ |
| Example 5 | 60 to 75 | ○ | ○ | ○ | ○ | ○ | ○ |
| Example 6 | 80 to 90 | ○ | ○ | ○ | ○ | ○ | ○ |
| Comparative example | — | Δ | X | XX | XX | XX | XX |

*1$C_B/C_A$: ratio (%) of cross sectional area ($C_B$) of the intermediate layer against the entire cross sectional area ($C_A$) of the alloy coat
○: No red rust is generated on the alloy coat.
Δ: A small amount of spot-like rust is generated on the alloy coat.
X: Surface area of red rust generated on the alloy coat is 5% or less of the entire surface area of the alloy coat.
XX: Surface area of red rust generated on the alloy coat is more than 5% of the entire surface area of the alloy coat.

EXAMPLES 7 TO 14

A surface roughness of the alloy coat is improved by utilizing a Zn molten bath including a small amount of additive element. Therefore, the effect of the additive element into the Zn molten bath for improving the surface roughness of the alloy coat was examined in examples 7–14. After the pre-treatments were performed on the articles, the undercoats of examples 7–14 were formed on the articles by dipping the articles into Zn molten bathes, respectively, including different additive elements such as Ni, Ti, Al and Mg. Then, each of the undercoats was dipped into an alloy molten bath to form the alloy coat on the undercoat. More details about hot-dip coating conditions for producing examples 7–14 are shown in TABLE 5. Cross sections of the alloy coats of examples 7–14 observed by an electron microscope are also shown in FIGS. 9-16, respectively. The observations indicate that each of the alloy coats of examples 8–14 has a smooth surface equal to, or better than the alloy coat which was formed through dipping the article into a Zn molten bath including 0.01 wt % of Al of example 7. The three corrosion tests of examples 1–6 were also performed in examples 7–14. All alloy coats of examples 7–14 demonstrated excellent corrosion resistance without generation of red rust, even after being exposed in the sulfurous acid gas for 480 hours, or in the salt spray test for 5000 hours, or in the salt spray test with the acetic acid for 2500 hours.

TABLE 5

Hot-dip coating conditions for producing examples 7 to 14.

| | FIRST HOT DIPPING STEP | | | | SECOND HOT DIPPING STEP | | | |
|---|---|---|---|---|---|---|---|---|
| | Bath composition (wt %) | Bath temperature (°C.) | Dipping time (sec) | Transport time*1 (sec) | Bath composition (wt %) | Bath temperature (°C.) | Dipping time (sec) | Cooling rate*2 (°C./sec) |
| Example 7 | Zn-0.01Al | 480 | 60 | 60 | Zn-55Al-1.6Si | 600 | 40 | −7 |
| Example 8 | Zn-0.3Al | 480 | 60 | 60 | Zn-55Al-1.6Si | 600 | 40 | −7 |
| Example 9 | Zn-0.5Al-0.5Ni | 480 | 60 | 60 | Zn-55Al-1.6Si | 600 | 40 | −7 |
| Example 10 | Zn-0.5Ni | 480 | 60 | 60 | Zn-55Al-1.6Si | 600 | 40 | −7 |
| Example 11 | Zn-0.1Ti-0.3Ni-0.3Al-0.03Si | 480 | 60 | 60 | Zn-55Al-1.6Si | 600 | 40 | −7 |
| Example 12 | Zn-0.5Mg | 480 | 60 | 60 | Zn-55Al-1.6Si | 600 | 40 | −7 |
| Example 13 | Zn-0.2Ni-0.5Mg | 470 | 30 | 30 | Zn-55Al-2.8Si | 600 | 60 | −4 |
| Example 14 | Zn-0.05Ni-0.01Mg | 450 | 40 | 40 | Zn-55Al-2.8Si | 610 | 60 | −5 |

*1An article with an undercoat is transported from a first molten bath to a second molten bath within a transport time.
*2An alloy coat is cooled at a cooling rate from a bath temperature of the second molten bath to 370° C. after being withdrawn from the second molten bath.

EXAMPLES 15 TO 20

Figure 17:
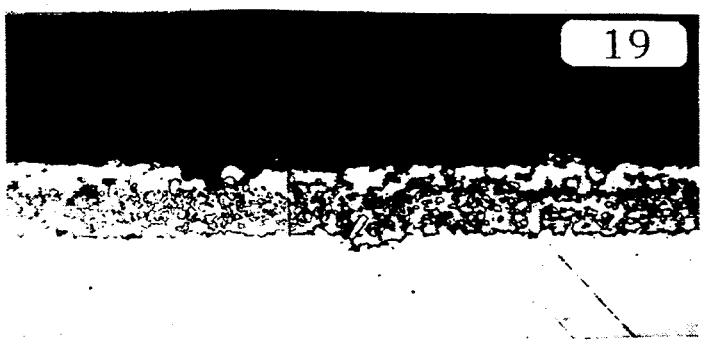
FIG. 17 is a cross section of an alloy coat of example 15 observed by the electron microscope.
Figure 18:
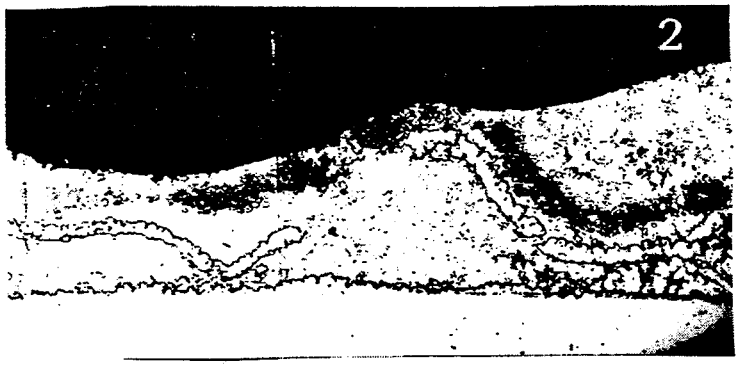
FIG. 18 is a cross section of an alloy coat of example 16 observed by the electron microscope.
Figure 19:
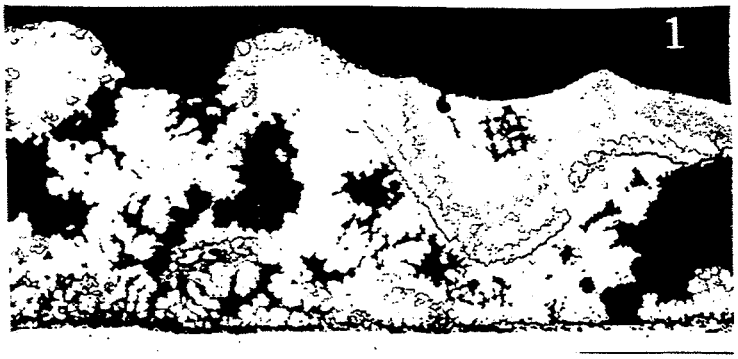
FIG. 19 is a cross section of an alloy coat of example 17 observed by the electron microscope.
Figure 20:
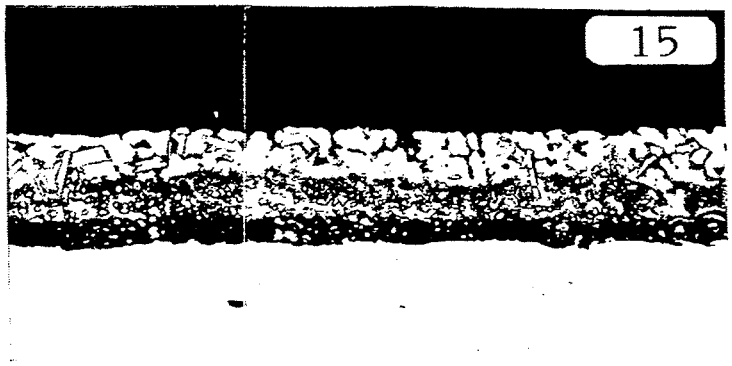
FIG. 20 is a cross section of an alloy coat of example 18 observed by the electron microscope.
Figure 21:
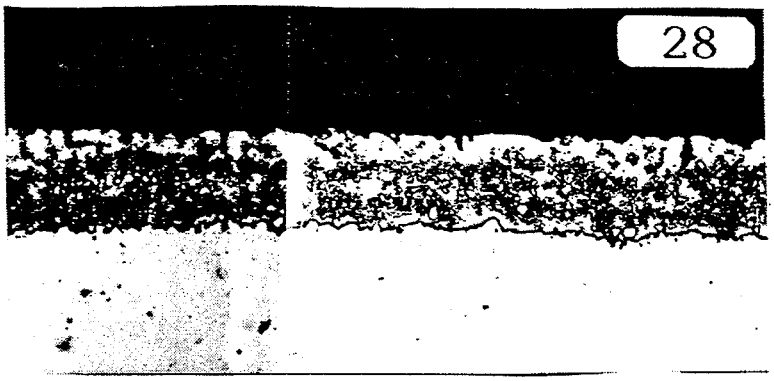
FIG. 21 is a cross section of an alloy coat of example 19 observed by the electron microscope.
Figure 22:
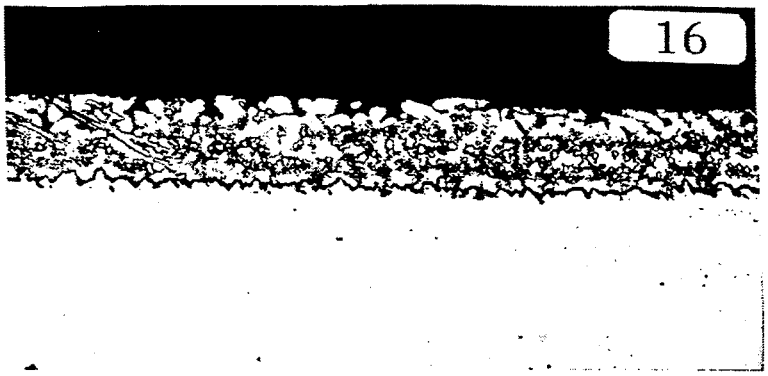
FIG. 22 is a cross section of an alloy coat of example 20 observed by the electron microscope.
Figure 23:
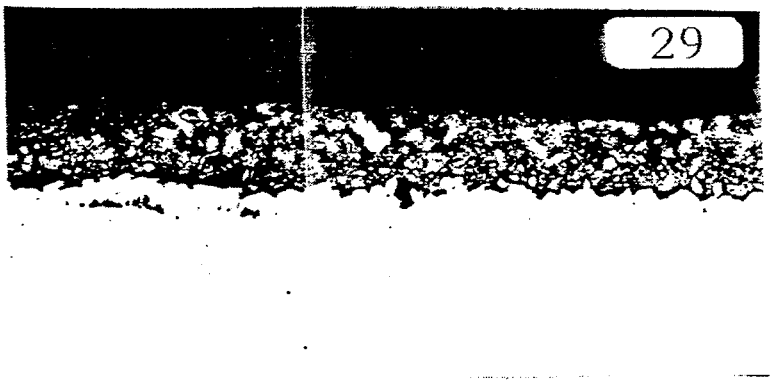
FIG. 23 is a cross section of an alloy coat of example 21 observed by the electron microscope.
Figure 24:
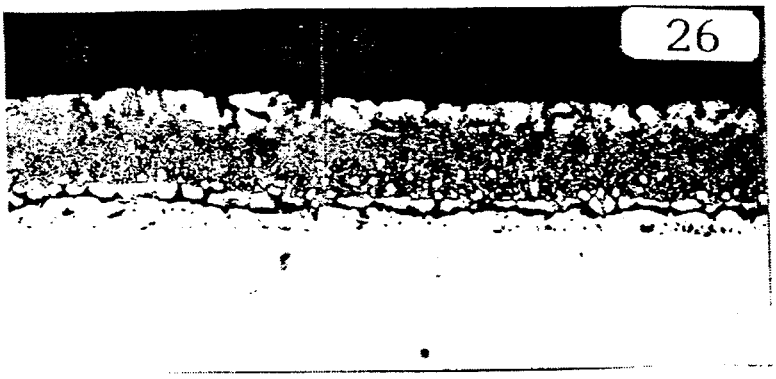
FIG. 24 is a cross section of an alloy coat of example 22 observed by the electron microscope.
Figure 25:
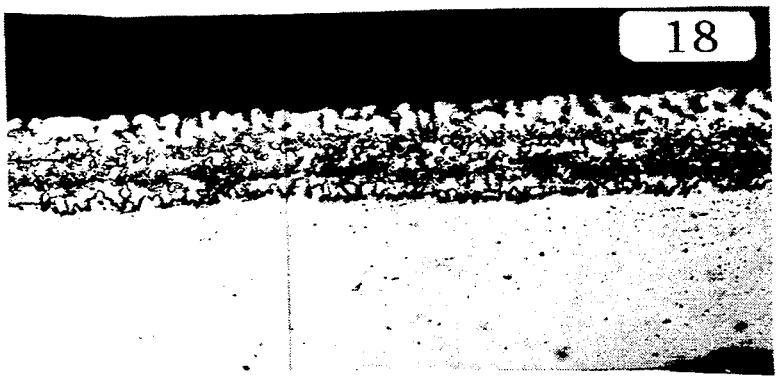
FIG. 25 is a cross section of an alloy coat of example 23 observed by the electron microscope.
Figure 26:
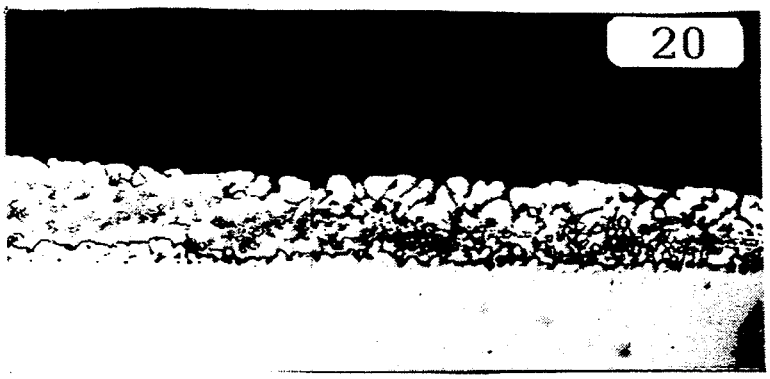
FIG. 26 is a cross section of an alloy coat of example 24 observed by the electron microscope.

The surface roughness of the alloy coat is also improved by varying hot-dip coating conditions. Therefore, bath temperature and bath composition of the Zn molten bath for improving the surface roughness of the alloy coat were examined in examples 15–20. After the pre-treatments were performed on the articles, the undercoats of examples 15–17 were formed on the articles by dipping the articles into a Zn molten bath including 0.01 wt % of Al at different bath temperatures, respectively. Then, each of the undercoats was dipped into an alloy molten bath consisting of 55 wt % of Al, 1.6 wt % of Si and the balance of Zn to form the alloy coat on the undercoat. More details about hot-dip coating conditions for producing examples 15–17 are shown in TABLE 6. Cross sections of the alloy coats of examples 15–17 observed by an electron microscope are shown in FIGS. 17-19, respectively. The observations of examples 15–17 indicate that the surface roughness of the alloy coat depends on the bath temperature of the Zn molten bath, that is, higher the bath temperature, more rough the surface of the alloy coat as shown in FIGS. 18 and 19. Therefore, when the Zn molten bath including 0.01 wt % Al is utilized to form the undercoat, the bath temperature of the Zn molten bath of about 450° C. is preferable to obtain the alloy coat having the smooth surface. On the other hand, the undercoats of examples 18–20 were formed by dipping the articles into a Zn molten bath including 0.5 wt % Al and 0.5 wt % of Ni at different temperatures, respectively. Then, each of the undercoats was dipped into the alloy molten bath of examples 15–17 to form the alloy coat on the undercoat. More details about hot-dip coating conditions for producing examples 18–20 are shown in TABLE 6. When the Zn molten bath including 0.5 wt % Al and 0.5 wt % Ni was utilized to form the undercoats, the bath temperature of the Zn molten bath between 450° C. and 520° C. was useful to obtain the smooth surface of the alloy coat. Therefore, a practical range of bath temperature of a Zn molten bath for forming the smooth surface of the alloy coat is extended by adding a small amount of optimum additive element into the Zn molten bath. The three corrosion tests of examples 1–6 were also performed in examples 15–20. All alloy coats of examples 15–20 demonstrated excellent corrosion resistance without generation of red rust, even after being exposed in the sulfurous acid gas for 480 hours, or in the salt spray test for 5000 hours, or in the salt spray test with the acetic acid for 2500 hours.

TABLE 6

Hot-dip coating conditions for producing examples 15 to 20.

| | FIRST HOT DIPPING STEP | | | | SECOND HOT DIPPING STEP | | | |
|---|---|---|---|---|---|---|---|---|
| | Bath composition (wt %) | Bath temperature (°C.) | Dipping time (sec) | Transport time*1 (sec) | Bath composition (wt %) | Bath temperature (°C.) | Dipping time (sec) | Cooling rate*2 (°C./sec) |
| Example 15 | Zn-0.01Al | 450 | 60 | 60 | Zn-55Al-1.6Si | 620 | 40 | −5 |
| Example 16 | Zn-0.01Al | 480 | 60 | 60 | Zn-55Al-1.6Si | 620 | 40 | −5 |
| Example 17 | Zn-0.01Al | 520 | 60 | 60 | Zn-55Al-1.6Si | 620 | 40 | −5 |
| Example 18 | Zn-0.5Al-0.5Ni | 450 | 60 | 60 | Zn-55Al-1.6Si | 620 | 40 | −5 |
| Example 19 | Zn-0.5Al-0.5Ni | 480 | 60 | 60 | Zn-55Al-1.6Si | 620 | 40 | −5 |
| Example 20 | Zn-0.5Al-0.5Ni | 520 | 60 | 60 | Zn-55Al-1.6Si | 620 | 40 | −5 |

*1An article with an undercoat is transported from a first molten bath to a second molten bath within a transport time.
*2An alloy coat is cooled at a cooling rate from a bath temperature of the second molten bath to 370° C. after being withdrawn from the second molten bath.

EXAMPLES 21 TO 24

A micro structure of the intermediate layer of the alloy coat is controlled by the cooling rate of the alloy coat. Therefore, an effect of the cooling rate for controlling to the micro structure of the intermediate layer was examined in examples 21-24. After the pre-treatments were performed on the articles, the undercoats were formed on the articles by dipping the articles into a Zn molten bath including 0.3 wt % of Al at 480° C. for 60 seconds. The alloy coats of examples 21-24 were formed on the undercoats by dipping the undercoats into an alloy molten bath including 55 wt % of Al, 2.3 wt % of Si and the balance of Zn at 590° C. for 30 seconds, and then were cooled at four different cooling rates, respectively, after being withdrawn from the alloy molten bath. More details about hot-dip coating conditions for producing examples 21-24 are also shown in TABLE 7. Cross sections of the alloy coats of examples 21-24 observed by the electron microscope are shown in FIGS. 23-26, respectively. The observations indicate that the intermediate layer was formed into a fine and zonal structure when the cooling rate was in a range between −3° and −7° C./sec, however, when the cooling rate was more than −7° C./sec, the intermediate layer was mostly formed into a granular structure. Therefore, the cooling rate of the alloy coat which is −7° C./sec or less is preferable to form the fine and zonal structure of the intermediate layer. The three corrosion tests of examples 1-6 were also performed in examples 21-24. All alloy coats of examples 21-24 demonstrated excellent corrosion resistance without generation of red rust even after being exposed in the sulfurous acid gas for 480 hours, or in the salt spray test for 5000 hours, or in the salt spray test with the acetic acid for 2500 hours.

TABLE 7

Hot-dip coating conditions for producing examples 21 to 24.

| | FIRST HOT DIPPING STEP | | | | SECOND HOT DIPPING STEP | | | |
|---|---|---|---|---|---|---|---|---|
| | Bath composition (wt %) | Bath temperature (°C.) | Dipping time (sec) | Transport time*1 (sec) | Bath composition (wt %) | Bath temperature (°C.) | Dipping time (sec) | Cooling rate*2 (°C./sec) |
| Example 21 | Zn-0.3Al | 480 | 60 | 30 | Zn-55Al-2.3Si | 590 | 30 | −3 |
| Example 22 | Zn-0.3Al | 480 | 60 | 30 | Zn-55Al-2.3Si | 590 | 30 | −5 |
| Example 23 | Zn-0.3Al | 480 | 60 | 30 | Zn-55Al-2.3Si | 590 | 30 | −7 |
| Example 24 | Zn-0.3Al | 480 | 60 | 30 | Zn-55Al-2.3Si | 590 | 30 | −9 |

*1An article with an undercoat is transported from a first molten bath to a second molten bath within a transport time.
*2An alloy coat is cooled at a cooling rate from a bath temperature of the second molten bath to 370° C. after being withdrawn from the second molten bath.

What is claimed is:

1. A corrosion resistant article comprising a ferrous base and an alloy covering the surface of the ferrous base, wherein the alloy comprises an interface layer disposed on the ferrous base and an intermediate layer disposed on the interface layer, and an outer layer disposed on the intermediate layer, the interface layer consists essentially of Fe, Zn, and at least one member of the group consisting of Al, Si, Mg, Ti, In, Tl, Sb, Nb, Co, Bi, Mn, Na, Ca, Ba, and Ni, the intermediate layer consists essentially of 55-65 wt % Al, 5-10 wt % Fe, 2-4 wt % Si, and 25-35 wt % Zn, and the outer layer consists essentially of Al, Zn, and Si and the intermediate layer has a cross-sectional area of 15 to 90% of the entire cross-sectional area of the alloy.

2. A corrosion resistant articles as defined in claim 1, wherein the intermediate layer has a Vickers microhardness of 150-200 Hv.

3. A corrosion resistant articles as defined in claim 1, wherein the interface layer has a Vickers microhardness of 450-500 Hv.

4. A corrosion resistant articles as defined in claim 1, wherein the interface layer consists essentially of 51.9 to 53.6 wt % Al, 10.4 to 12.2 wt % Zn, 8.46 to 9.37 wt % Si, and 25.3 to 29.3 wt % Fe and at least one member of the group consisting of Al, Si, Mg, Ti, In, Tl, Sb, Nb, Co, Bi, Mn, Na, Ca, Ba, and Ni.

5. A corrosion resistant articles as defined in claim 1, wherein the outerlayer consists essentially of 0.20 to 0.32 wt % Fe, 24.5 to 29.0 wt % Zn, 72.4 to 76.5 wt % Al, and 0.32 to 0.85 wt % Si.

6. An alloy coated product according to claim 1, wherein said intermediate layer is formed into a granular structure.

7. An alloy coated product according to claim 1, wherein said intermediate layer is formed into a fine and densely distributed structure.

8. An alloy coated product according to claim 1, wherein a amount of Fe included in said intermediate layer is less than that in said interface layer.

9. An alloy coated product according to claim 1, wherein a amount of Si included in said intermediate layer is less than that in said interface layer.

10. An alloy coated product according to claim 1, wherein a amount of Zn included in said intermediate layer is more than that in said interface layer.

* * * * *